US007469802B2

(12) United States Patent
Milian et al.

(10) Patent No.: US 7,469,802 B2
(45) Date of Patent: Dec. 30, 2008

(54) FLUID DISPENSER HAVING A DEFORMABLE SLEEVE

(75) Inventors: Alex Milian, Breteuil sur Iton (FR); Fabienne Uguen, Le Val David (FR)

(73) Assignee: Valois S.A.S., Le Neubourg (FR)

( * ) Notice: Subject to any disclaimer, the term of this patent is extended or adjusted under 35 U.S.C. 154(b) by 792 days.

(21) Appl. No.: 10/835,176

(22) Filed: Apr. 30, 2004

(65) Prior Publication Data

US 2004/0222240 A1 Nov. 11, 2004

Related U.S. Application Data

(60) Provisional application No. 60/495,900, filed on Aug. 19, 2003.

(30) Foreign Application Priority Data

May 7, 2003 (FR) ..... 03 05605

(51) Int. Cl.
*B67D 5/06* (2006.01)

(52) U.S. Cl. ..... 222/183

(58) Field of Classification Search ..... 222/105, 222/183, 192, 206, 321.7, 205
See application file for complete search history.

(56) References Cited

U.S. PATENT DOCUMENTS

| | | | | |
|---|---|---|---|---|
| 4,196,817 | A * | 4/1980 | Moser | 215/12.1 |
| 4,593,408 | A | 6/1986 | Drobish | |
| 6,053,363 | A * | 4/2000 | Revenu | 222/82 |
| 6,126,318 | A * | 10/2000 | Bell | 383/209 |
| 6,135,322 | A * | 10/2000 | Cetrangolo | 222/105 |
| 6,726,016 | B2 * | 4/2004 | Chen | 206/581 |
| 6,811,057 | B2 * | 11/2004 | Duquet et al. | 222/105 |

FOREIGN PATENT DOCUMENTS

| | | |
|---|---|---|
| DE | 296 16 838 U | 12/1996 |
| EP | 1 275 590 A | 1/2003 |

* cited by examiner

*Primary Examiner*—Kevin P Shaver
(74) *Attorney, Agent, or Firm*—Sughrue Mion, PLLC

(57) ABSTRACT

A fluid dispenser assembly including a fluid dispenser (1) having a fluid reservoir (11) and a dispensing orifice (12). The dispenser also includes a sleeve (2) in which the fluid dispenser (1) is slidably mounted. The sleeve (2) is deformable between a dispenser reception position, in which it holds the dispenser (1) inside the sleeve (2), and a dispenser dispensing position, in which the dispenser (1) can be extracted from the sleeve (2), in particular by gravity.

19 Claims, 3 Drawing Sheets

FLUID DISPENSER HAVING A DEFORMABLE SLEEVE

CROSS REFERENCE TO RELATED APPLICATION

This application claims the benefit under 35 U.S.C. §119 (e) of U.S. provisional patent application Ser. No. 60/495,900, filed Aug. 19, 2003, and priority under 35 U.S.C. §119 (a)-(d) of French patent application No. FR-03.05605, filed May 7, 2003.

TECHNICAL FIELD

The present invention relates to a fluid dispenser assembly, and in particular to such an assembly that comprises a fluid dispenser and a sleeve in which said fluid dispenser is slidably and removably mounted. The term fluid is used to designate any substances or products that are liquid, semi-liquid, or indeed in power form, and that are suitable for being applied to an application surface or for being dispensed into the atmosphere in any manner whatsoever. This type of dispenser assembly is encountered in particular in the fields of perfumes, of cosmetics, or indeed of pharmaceuticals.

BACKGROUND OF THE INVENTION

In the field of perfume samples in particular, it is known that trim such as a sleeve can be provided for the sample, specifically for the purpose of making it possible to display the brand of the perfume or other information of interest to the user. The sizes of such samples, in particular when they are substantially cylindrical in shape, are often insufficient to enable such advertising to be displayed on them.

SUMMARY OF THE INVENTION

An object of the present invention is to provide such a dispenser assembly that is particularly simple and inexpensive to manufacture and to assemble.

Another object of the present invention is to provide such a dispenser assembly that is simple to use and that can be re-used several times.

A further object of the invention is to provide such a dispenser assembly that can be used with one hand only.

To these ends, the present invention provides a fluid dispenser assembly comprising: a fluid dispenser having a fluid reservoir and a dispensing orifice; and a sleeve in which the fluid dispenser is slidably mounted; the sleeve being deformable to go between a dispenser reception position, in which it holds said dispenser inside said sleeve, and a dispenser dispensing position, in which said dispenser can be extracted from said sleeve, in particular by gravity.

Advantageously, in the reception position, the dispenser is held in the sleeve by friction.

Advantageously, the sleeve is deformed from its reception position to its dispensing position by applying a compression force to two opposite side edges of said sleeve, in particular its longitudinal edges.

Advantageously, said sleeve is provided with abutment means for limiting the extent to which the dispenser can slide inside the sleeve, thereby defining the reception position.

Advantageously, said abutment means are formed integrally with said sleeve, by folding and/or cutting out at least one portion of said sleeve.

In a first variant embodiment, said sleeve is made up of two sheets bonded together with adhesive along their respective side edges, and defining between said edges as bonded together a recess for receiving the dispenser.

In a second variant embodiment, said sleeve is formed by folding a one-piece sheet and bonding it together with adhesive, and by defining a recess for receiving the dispenser between the fold and the bonding.

Advantageously, in the reception position, said recess has dimensions in a thickness direction that are substantially identical to the corresponding dimensions of the dispenser, and dimensions in a transverse direction that are greater than the corresponding dimensions of the dispenser, so that the walls of said recess in said thickness direction co-operate with said dispenser to hold it in said recess, in particular by friction.

Advantageously, in the dispensing position, when the user applies a compression force on the side edges of the sleeve in said transverse direction, the recess has dimensions both in said thickness direction and in said transverse direction that are greater than the corresponding dimensions of the dispenser.

Advantageously, said dispenser is substantially cylindrical and comprises a reservoir, a pump, and a dispensing head provided with a dispensing orifice.

BRIEF DESCRIPTION OF THE DRAWINGS

Other advantageous characteristics of the present invention appear more clearly on reading the following detailed description of two embodiments, given with reference to the accompanying drawings, which are given by way of non-limiting example and in which.

DETAILED DESCRIPTION OF THE INVENTION

The present invention is described below with reference to two particular embodiments, but it is to be understood that other variants may also be considered. In particular, the outside shapes of the dispenser and of the sleeve are given merely by way of indication, and they may be implemented in any desirable shape.

Figure 1:
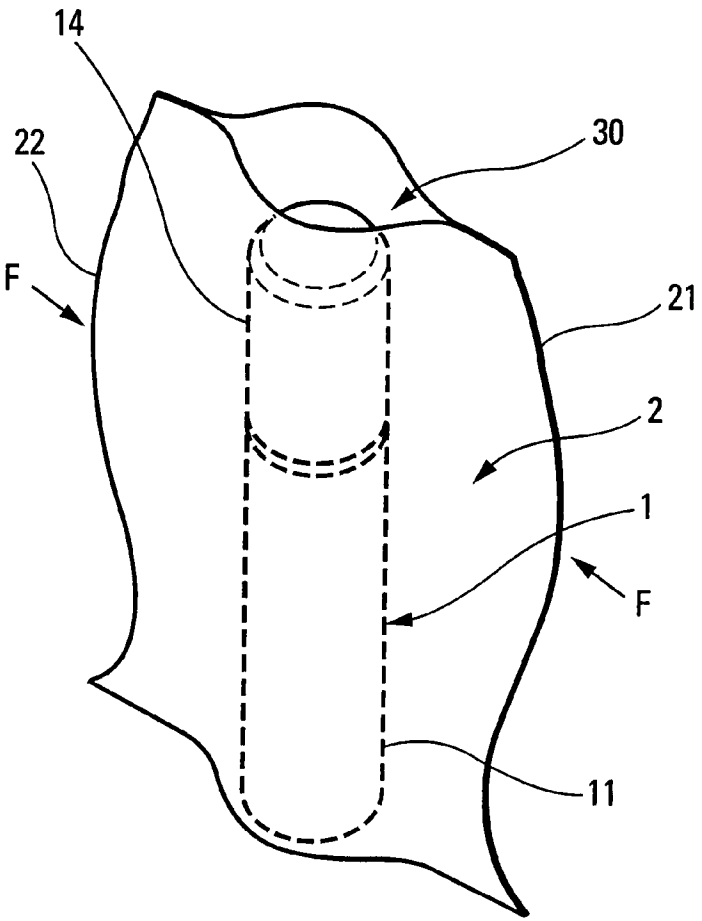
FIG. 1 is a diagrammatic view partially in perspective showing a dispenser assembly in a first embodiment of the present invention, in the reception position, with the dispenser being shown in dashed lines as inserted into the sleeve.
Figure 2:
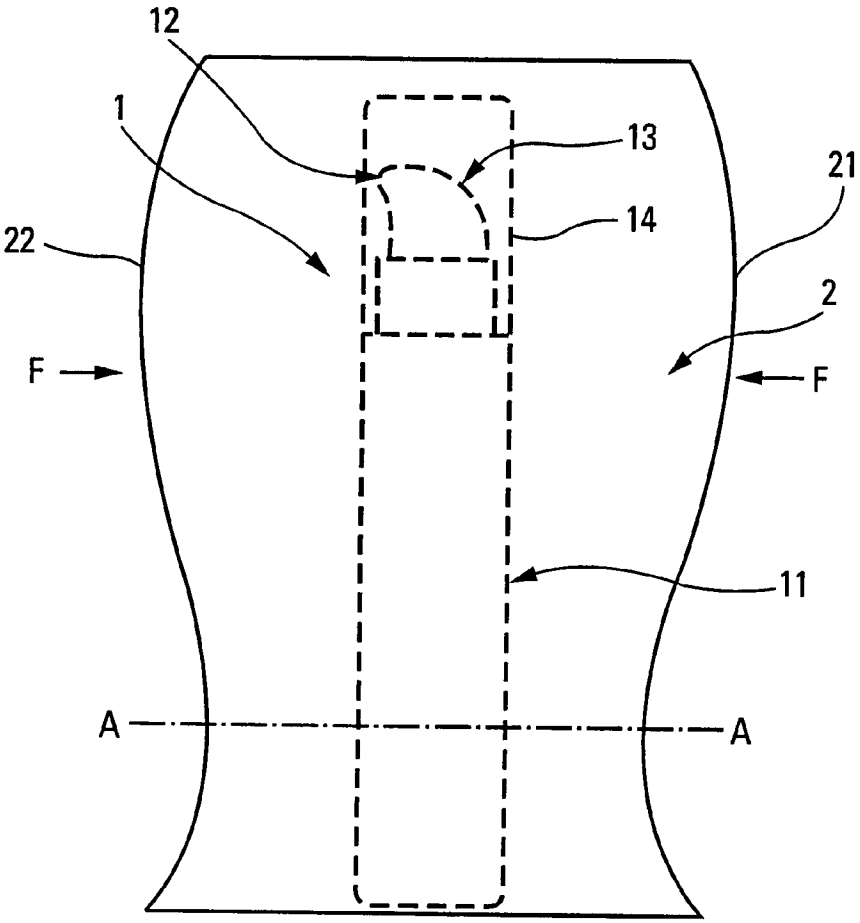
FIG. 2 is a diagrammatic plan view of the assembly of FIG. 1.

With reference more particularly to FIGS. 1 and 2, the present invention covers a dispenser assembly comprising a fluid dispenser 1 and a sleeve 2 in which said dispenser is removably inserted, and the dispenser 1 is mounted to slide between a reception position shown in FIGS. 1 and 2 and in which said dispenser is inside the sleeve, and a dispensing position in which the dispenser is out of the sleeve and can be used by the user. The dispenser 1 shown in the figures is substantially cylindrical and comprises a reservoir 11 to which a spray pump (not shown) is fitted, as is a dispensing head 13 provided with a dispensing orifice 12. Optionally, a protective cap may be assembled around said head 13. When the user wishes to dispense a metered quantity or "dose" of fluid contained in the reservoir 11, said user removes said protective cap 14 and exerts axial pressure on the dispensing head 13, thereby actuating the pump and discharging a dose of fluid in spray form through the dispensing orifice 12. After dispensing, the user can put the protective cap 14 back in place around the dispensing head 13. Naturally, the present invention is applicable to all types of fluid dispenser, and in particular, the present invention is applicable to dispensers that are not cylindrical in shape.

In the invention, the dispenser assembly further comprises a sleeve 2 into which the dispenser can be inserted in removable manner. More precisely, the sleeve 2 is deformable to go from the reception position in which it holds the dispenser 1 inside said sleeve 2 to a dispenser dispensing position in which the dispenser 1 can be extracted from the sleeve 2. Preferably, the sleeve 2 is caused to deform to go from the reception position to the dispensing position by applying a compression force on two opposite side edges 21, 22 of said sleeve 2. Preferably, the edges in question are the two longitudinal edges of the sleeve. The drawings diagrammatically show the direction in which said compression force F is applied, making it possible to deform the sleeve to cause it to go from its reception position to its dispensing position. The sleeve 2 is preferably substantially rectangular in shape, with dimensions greater than those of the dispenser, so that, in the reception position, the dispenser 1 is inserted completely inside the sleeve 2. Naturally, it is also possible to imagine a sleeve 2 that is smaller than the dispenser 1, said dispenser then projecting from said sleeve 1, even in the reception position. FIGS. 1 and 2 are shown with side edges 21, 22 of the sleeve that are not rectilinear in shape. This is to illustrate the variant embodiments in which the sleeve 1 may take any outside shape, e.g. shapes corresponding to bottles of perfume of which the dispenser 1 is a sample. Between the side edges 21 and 22, the sleeve 2 defines a recess 30 which is which serves to receive to receive said dispenser 1.

Figure 3:
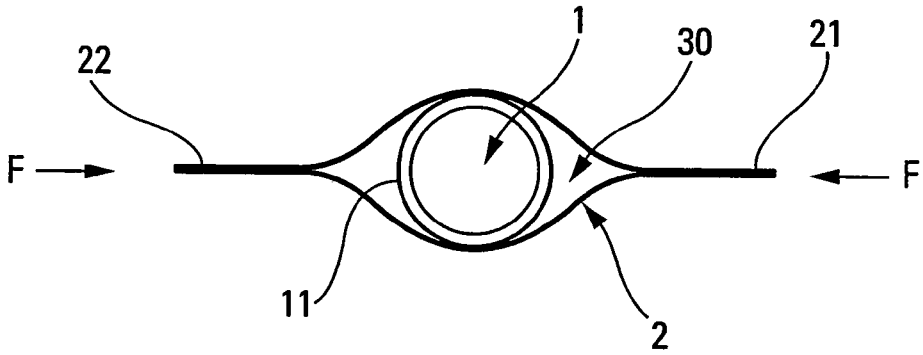
FIGS. 3 and 4 are diagrammatic cross-section views on section line AA of FIG. 2, showing the assembly respectively in the reception position and in the dispensing position.
Figure 4:
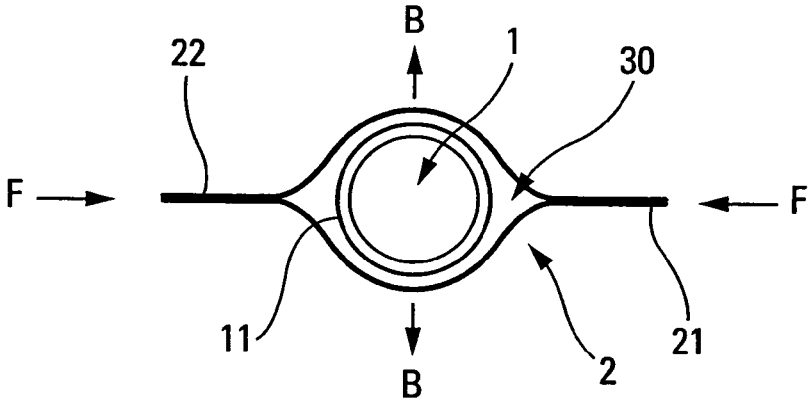

FIGS. 3 and 4, which are views on the section line AA of FIG. 2, respectively in the reception position and in the dispensing position, show more clearly how said sleeve 2 is deformed to go from one position to the other. FIG. 3 shows that, in the reception position, the dispenser 1, and in particular the reservoir 11 is held inside the recess 30 by contact with the walls of the recess 30 in one direction, referred to herein as the "thickness direction". In said thickness direction, the recess 30 thus has dimensions that are substantially identical to the dimensions of the dispenser. In a transverse direction that is substantially perpendicular to said thickness direction, and that corresponds to the direction in which the compression force F is applied, it can be observed that the recess 30 has dimensions greater than the corresponding dimensions of the dispenser 1. Thus, when the user exerts the compression force on the two opposite side edges 21, 22 of the sleeve, the recess 30 can deform by reducing its dimensions in the transverse direction, and simultaneously by increasing its dimensions in the thickness direction, as shown by arrows B in FIG. 4. Thus, in the dispensing position, the recess 30 of the sleeve 2 has dimensions greater than the dimensions of the dispenser 1, both in the thickness direction and in the transverse direction. The dispenser 1 is then no longer retained by the walls of said recess 30, and it can be extracted from said sleeve, e.g. by gravity. Advantageously, the dispenser is held in the reception position inside the recess 30 in the sleeve 2 by friction between the corresponding walls of said recess 30 and of said dispenser. When the user wishes to use the dispenser, said user exerts the compression force on the side edges of the sleeve 2 and turns said sleeve upside down, so that the dispenser 1 can fall out of the sleeve under gravity. Naturally, it is possible to consider making provision for contact to exist between the recess 30 and the dispenser 1, even in the dispensing position. In certain variant embodiments, it is also possible to imagine making provision for the user to exert traction on the dispenser while simultaneously exerting the compression force on the sleeve, so as to make it easier to extract the dispenser. In which case, however, the user must use both hands to extract the dispenser from the sleeve, which does not apply in the above-described example.

Advantageously, the sleeve 2 is provided with abutment means 25 serving to limit the extent to which the dispenser 1 is inserted inside the sleeve 2, and thus to define the reception position. Said abutment means 25 are preferably provided on the side opposite from the insertion orifice of the recess 30, either by fixing an end wall, in particular by means of adhesive, or in integral manner by folding and/or cutting out a portion of the sleeve 2.

Figure 5:
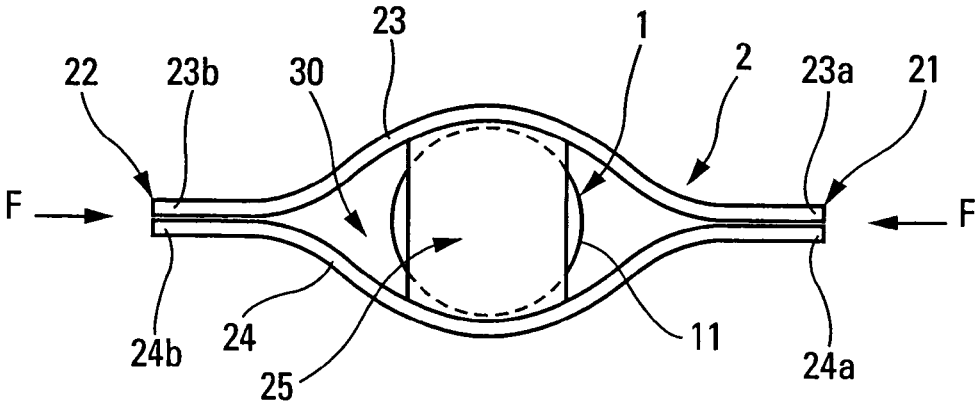
FIG. 5 is a diagrammatic view from below of a dispenser assembly in the first embodiment of the present invention, showing a variant of the abutment means.

As shown in FIG. 5, which shows a first embodiment, the sleeve 2 is made up of two sheets 23, 24 bonded together by adhesive along their respective edges 23*a* & 24*a* and 23*b* & 24*b*. Between said bonded edges, the two sheets 23, 24 define the recess 30 that receives the dispenser 1. FIG. 5 diagrammatically shows the abutment means 25 formed by an end wall that is bonded with adhesive to the two sheets 23 & 24, and that thus co-operates with the end-wall of the dispenser 1 when in the dispensing position.

Figure 6:
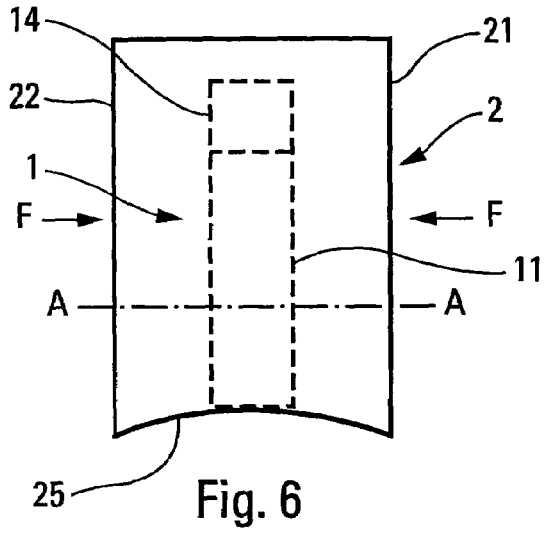
FIG. 6 is a diagrammatic plan view showing a second embodiment of the present invention, the dispenser being shown in dashed lines.
Figure 7:
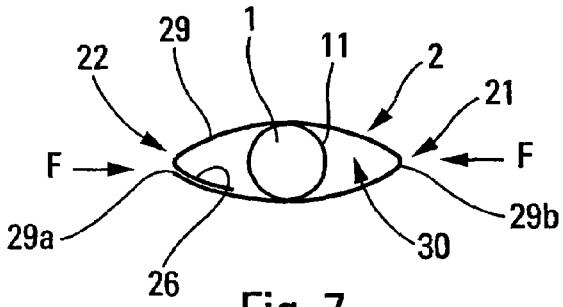
FIG. 7 is a diagrammatic cross-section view on the section line AA of FIG. 6, similar to the cross-section view of FIG. 3, and showing the second embodiment in the reception position.
Figure 8:
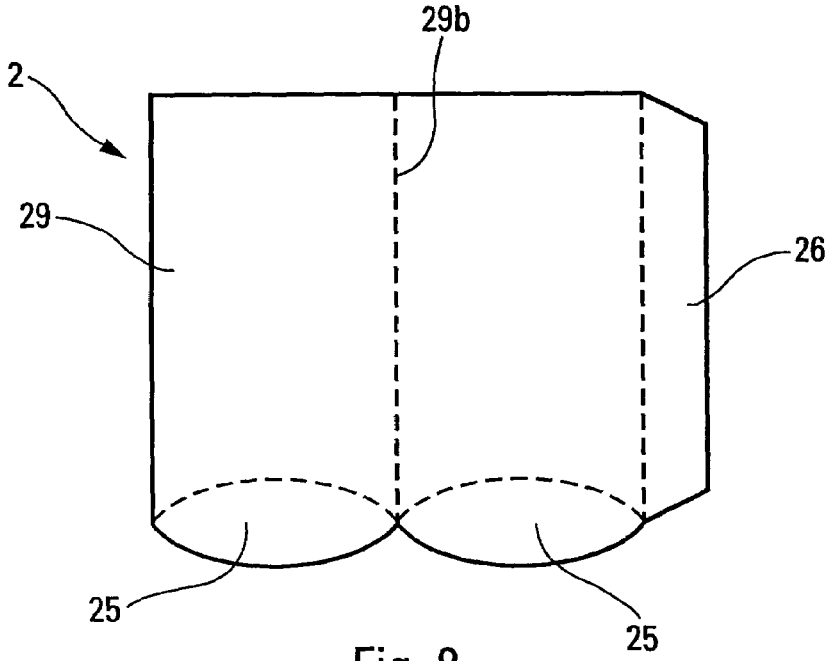
FIG. 8 is a diagrammatic plan view of the sleeve in the second embodiment before it is assembled, and showing, in particular, another variant of the abutment means.

FIGS. 6 to 8 show a second embodiment, in which the sleeve is made integrally from a single one-piece sheet 29. The one-piece sheet 29 is folded in half and then bonded with adhesive, thereby defining a fold 29*b* and bonding 29*a*. Advantageously, a flap 26 is provided for performing said bonding 29*a*. The recess 30 for receiving the dispenser is defined between said fold 29*b*, which forms one of the side edges (21), and the bonding 29*a* which forms the other side edge 22. Advantageously, the one-piece sheet 29 may further be provided with a foldable extension 25 that is folded in from the one-piece sheet 29 so as to form the abutment means 25. Advantageously, each portion of the sheet 29 on either side of the fold 29*b* may be provided with such an extension, as shown in FIG. 8. After the sleeve has been assembled, the two extensions 25 are then mutually superposed to form the end-wall of the recess 30, as shown in FIG. 6. This implementation makes it very simple to provide abutment means 25 limiting the extent to which the dispenser is inserted into the sleeve 2. This implementation avoids complex operations requiring a separate additional part to be added to the construction of the sleeve. Thus, in the example shown in FIGS. 6 to 8, the sleeve is formed from a single piece 29 by folding and bonding with adhesive. In a variant, it is also possible to make provision for the abutment means to be formed by cutting out, optionally associated with folding.

Naturally, various modifications may be devised by the person skilled in the art without going beyond the ambit of the present invention, as defined by the accompanying claims.

The invention claimed is:

1. A fluid dispenser assembly comprising:

a fluid dispenser (1) having a fluid reservoir (11) and a dispensing orifice (12); and a sleeve (2) in which the fluid dispenser (1) is slidably mounted;

said fluid dispenser assembly being characterized in that the sleeve (2) is deformable to go between a dispenser reception position, in which said sleeve holds said dispenser (1) by friction inside said sleeve (2), and a dispenser dispensing position, in which said dispenser (1) can be extracted from said sleeve (2).

2. A dispenser assembly according to claim 1, in which the sleeve (2) is deformed from its reception position to its dispensing position by applying a compression force (F) to two opposite side edges (21, 22) of said sleeve (2).

3. A dispenser assembly according to claim 1, in which said sleeve (2) is provided with abutment means (25) for limiting an extent to which the dispenser (1) can slide inside the sleeve (2), thereby defining the reception position.

4. A dispenser assembly according to claim 3, in which said abutment means (25) are formed integrally with said sleeve (2), by folding at least one portion (25) of said sleeve (2).

5. A dispenser assembly according to claim 1, in which said sleeve (2) is made up of two sheets (23, 24) bonded together with adhesive along respective side edges (23*a*, 24*a*; 23*b*, 24*b*), and defining between said edges as bonded together a recess (30) for receiving the dispenser (1).

6. A dispenser assembly according to claim 1, in which said sleeve (2) is formed by folding a one-piece sheet (29) to form a fold and bonding said sheet together with adhesive, and by defining a recess (30) for receiving the dispenser (1) between the fold (29*b*) and the bonding (29*a*).

7. A dispenser assembly according to claim 5, in which, in the reception position, said recess (30) has dimensions in a thickness direction that are substantially identical to the corresponding dimensions of the dispenser (1), and dimensions in a transverse direction that are greater than the corresponding dimensions of the dispenser (1), so that walls of said recess (30) in said thickness direction co-operate with said dispenser (1) to hold said dispenser by friction in said recess (30), in particular by friction.

8. A dispenser assembly according to claim 7, in which, in the dispensing position, when a user applies a compression force (F) on the side edges (21, 22) of the sleeve (2) in said transverse direction, the recess (30) has dimensions both in said thickness direction and in said transverse direction that are greater than the corresponding dimensions of the dispenser (1).

9. A dispenser assembly according to claim 1, in which said dispenser (1) is substantially cylindrical and comprises a reservoir (11), a pump, and a dispensing head (13) forming the dispensing orifice (12), the dispenser being held by friction inside the sleeve at two opposite tight contact zones extending substantially over a whole length of the dispenser.

10. The dispenser assembly according to claim 3, in which the abutment means (25) are formed integrally with the sleeve (2), by cutting out at least one portion (25) of the sleeve (2).

11. A fluid dispenser assembly comprising:

a fluid dispenser having a fluid reservoir and a dispensing orifice; and a sleeve in which the fluid dispenser is slidably held;

wherein the sleeve is deformable between a dispenser reception configuration and a dispenser dispensing configuration;

wherein, in the dispenser reception configuration, the sleeve holds the dispenser by friction inside said sleeve with sufficient force to maintain the dispenser inside the sleeve when the sleeve is in a vertically inverted position with an opening of the sleeve facing downward; and wherein, in the dispenser dispensing configuration, the dispenser can be extracted from said sleeve.

12. The dispenser assembly according to claim 11, wherein, in the dispenser dispensing configuration, the dispenser falls from the sleeve due to the weight of the dispenser when the sleeve is in the vertically inverted position with the opening of the sleeve facing downward.

13. The dispenser assembly according to claim 11, wherein the dispenser assembly is deformed to be in the dispenser dispensing configuration by applying inwardly directed opposing forces to opposite longitudinal edges of the sleeve.

14. The dispenser assembly according to claim 11, wherein the sleeve comprises an abutment that limits an extent to which the dispenser can slide inside the sleeve.

15. The dispenser assembly according to claim 11, wherein the sleeve comprises two sheets bonded together with adhesive along side edges to define a recess that receives the dispenser.

16. The dispenser assembly according to claim 11, wherein the sleeve is formed by folding a one-piece sheet to form a fold and bonding the sheet together to define a recess that receives the dispenser between the fold.

17. The dispenser assembly according to claim 15, wherein, in the dispenser reception configuration, the recess has an opening with a thickness dimension where the sleeve frictionally contacts the dispenser that is substantially identical to the corresponding dimension of the dispenser, and the dimension of the opening of the recess in a direction transverse to the thickness dimension is greater than the thickness dimension.

18. The dispenser assembly according to claim 17, wherein, in the dispenser reception configuration, when a user applies a compression force to the side edges of the sleeve, the recess has a thickness dimension that is greater than the corresponding dimensions of the dispenser.

19. The dispenser assembly according to claim 11, wherein the dispenser is substantially cylindrical and comprises a reservoir, a pump, and a dispensing head forming the dispensing orifice, the dispenser held by friction inside the sleeve at two opposite tight contact zones extending substantially over a whole length of the dispenser.

* * * * *